US011794061B2

(12) United States Patent
Yao

(10) Patent No.: US 11,794,061 B2
(45) Date of Patent: Oct. 24, 2023

(54) CONVENIENT WEIGHT-ADJUSTABLE DUMBBELL

(71) Applicant: YONGKANG BANI FITNESS EQUIPMENT CO. , LTD., Jinhua (CN)

(72) Inventor: Renjun Yao, Jinhua (CN)

(73) Assignee: YONGKANG BANI FITNESS EQUIPMENT CO., LTD., Jinhua (CN)

( * ) Notice: Subject to any disclaimer, the term of this patent is extended or adjusted under 35 U.S.C. 154(b) by 0 days.

(21) Appl. No.: 18/097,446

(22) Filed: Jan. 16, 2023

(65) Prior Publication Data

US 2023/0173326 A1 Jun. 8, 2023

Related U.S. Application Data

(63) Continuation of application No. PCT/CN2021/093208, filed on May 12, 2021.

(30) Foreign Application Priority Data

May 27, 2020 (CN) ..... 202010460480.5

(51) Int. Cl.
*A63B 21/072* (2006.01)
*A63B 21/075* (2006.01)

(52) U.S. Cl.
CPC ..... *A63B 21/0728* (2013.01); *A63B 21/075* (2013.01); *A63B 21/0726* (2013.01)

(58) Field of Classification Search
CPC ..... A63B 21/0728; A63B 21/0726; A63B 21/072–075
See application file for complete search history.

(56) References Cited

U.S. PATENT DOCUMENTS 7,604,578 B2 10/2009 Liu
8,784,283 B2 * 7/2014 Svenberg ..... A63B 21/00069 482/106

(Continued)

FOREIGN PATENT DOCUMENTS

CN 205460661 U 8/2016
CN 107050748 A 8/2017

(Continued)

OTHER PUBLICATIONS

International Search Report and Written Opinion of PCT/CN2021/093208, dated Aug. 11, 2021.

(Continued)

*Primary Examiner* — Joshua Lee
*Assistant Examiner* — Catrina A Letterman
(74) *Attorney, Agent, or Firm* — Georgi Korobanov

(57) ABSTRACT

A convenient weight-adjustable dumbbell, comprising a handle, and two rotating disks, two connecting disks, and two fixed blocks, a flexible shaft is connected to the side of each rotating disk, the flexible shaft surrounds the center of the rotating disk, and the other end of the flexible shaft runs through the connecting disk and the fixed block, an outer side of each fixed block is detachably connected with at least one weight block, one side of each weight block is connected with a lock for connecting the fixed block, the other side of each weight block is provided with a second slot, and each weight block is provided with a insertion hole for—the flexible shaft to pass through.

8 Claims, 4 Drawing Sheets

(56) References Cited

U.S. PATENT DOCUMENTS

| | | | | |
|---|---|---|---|---|
| 9,616,273 | B2 | 4/2017 | Chen | |
| 2009/0197745 | A1* | 8/2009 | Olson | A63B 21/0728 482/107 |
| 2010/0304938 | A1* | 12/2010 | Olson | A63B 21/0728 482/107 |
| 2022/0257993 | A1* | 8/2022 | Geng | A63B 21/0728 |
| 2023/0080174 | A1* | 3/2023 | Paganelli | A63B 71/0622 |

FOREIGN PATENT DOCUMENTS

| | | | |
|---|---|---|---|
| CN | 209997094 | U | 1/2020 |
| CN | 111481878 | A | 8/2020 |
| CN | 212187621 | U | 12/2020 |

OTHER PUBLICATIONS

Written Opinion of the International Searching Authorty for No. PCT/CN2021/093208.

* cited by examiner

CONVENIENT WEIGHT-ADJUSTABLE DUMBBELL

CROSS-REFERENCE TO RELATED APPLICATIONS

This application is a continuation of co-pending International Patent Application No. PCT/CN2021/093208, filed on May 12, 2021, which claims the priority and benefit of Chinese patent application number 202010460480.5, filed May 27, 2020 with China National Intellectual Property Administration, the entire contents of which are incorporated herein by reference.

TECHNICAL FIELD

The present application relates to an adjustable dumbbell, in particular to a convenient weight-adjustable dumbbell.

BACKGROUND

Dumbbell is a kind of auxiliary equipment used for weightlifting and fitness exercises, which can exercise upper limb muscles, waist and abdominal muscles. Conventional dumbbells generally have two types: fixed weight and adjustable weight. Since the weight of fixed-weight dumbbells is not adjustable, the user must prepare a variety of dumbbells of different weights to achieve an effective exercise effect. Therefore, it is necessary to pay a lot of money for preparing various types of dumbbells, which also increases the space occupied by the dumbbells. The conventional weight-adjustable type requires the user to disassemble the dumbbell weight block and fix it through the conventional compression nut, which not only increases the operational complexity of the replacement of the dumbbell weight block, but is not conducive to the user's rapid adjustment of the dumbbell weight block. The weight block is replaced or added, which increases the preparation time for the user to exercise with dumbbells, and affects the fitness effect of the user's exercise.

SUMMARY

The present application mainly solves the technical problems existing in the prior art, thereby providing a convenient weight-adjustable dumbbell, which is simple to operate and easy to use, and is convenient for the user to quickly replace or add weight blocks, effectively reducing the time required for the user to adjust the weight of the dumbbell, and improve the effect of the user's exercise.

In order to solve the above technical problems, the present application is realized through the following technical solutions:

A weight-adjustable dumbbell, comprising a handle and a rotating disk connected to both ends of the handle, a connecting disk is movably connected to a side of the rotating disk, and a fixed block is connected to a side of the connecting disk, wherein a flexible shaft is connected to the side of the rotating disk, and the flexible shaft runs through the connecting disk and the fixed block, an outer side of the fixed block is detachably connected with weight blocks, one side of the weight block is connected with a lock for connecting the fixed block, the other side of the weight block is provided with a second slot, and the center of the weight block is provided with a insertion hole for the passage of the flexible shaft.

As a preference, a side of the fixed block is provided with a first slot that cooperates with the lock, and the lock is movably connected with the weight block. The second slot provided on the other side of the weight block is connected with the lock, and the lock is movably connected with the weight block, so that the lock can move on the surface of the weight block, so that the lock in the weight block can be snapped into the first slot. The weight block and the fixed block can be connected and fixed to each other, and the lock of the subsequent weight block is matched with the second slot of the previous weight block, so as to realize the connection and installation of multiple weight blocks.

As a preference, the center of the lock is connected with a pin shaft that is rotatably connected with the weight block, and an elastic member is arranged between the lock and the weight block, and one side of the lock is connected with a buckle for being locking into the first slot and the second slot. The elastic member can be a spring, so that the lock and the weight block are movably connected through a pin shaft, and can be fixed through the snap-fit connection between the buckle connected to the surface of the lock and the first or second slot. The arrangement of the elastic member allows the lock to return to its original position without external force. The snap fit connection between the buckle and the first slot facilitates the installation of the weight block on the fixed block. The buckle of the extra weight block is snap-fitted with the second slot of the previous weight block so as to facilitate the installation of the extra weight block on the previous weight block, thereby realizing sequentially stacked connections.

As a preference, the other side of the lock is connected to an abutment rod, and an end of the abutment rod is provided with a slide groove, and the slide groove is located on front of the insertion hole, so that the abutment rod can half cover the front of the insertion hole, and when the flexible shaft is embedded in the insertion hole, the abutment rod can be pressed, so that the pressing action of the abutment rod drives the lock to rotate, so that the buckle on the other side of the lock can be snapped into the first slot or the second slot. The arrangement of the slide groove at the end of the abutment rod facilitates the entry of the flexible shaft into the insertion hole, which not only facilitates the introduction of the flexible shaft into the insertion hole through the slide groove, but also avoids the possibility that the abutment rod is completely covered above the insertion hole so that the flexible shaft cannot enter the insertion hole.

As a preference, a through hole for passing the flexible shaft is arranged in the center of the fixed block, and the axial center of the through hole and the axial center of the insertion hole are on the same straight line, so that the flexible shaft can pass through the fixed block and the weight block through the through hole and the insertion hole, so that the flexible shaft connects the fixed block and the weight block to limit the position.

As a preference, a cylinder is connected to the center of the rotating disk, and a column buckle rotatably connected to the cylinder is provided at the center of the connecting disk. The cylinder and the column buckle can be connected by snap fit or by bearing rotation, so that the cylinder can be clipped and embedded in the column buckle, so that the rotating disk and the connecting disk can be connected through the cylinder and the column buckle, and allow the rotating disk to rotate on one side of the connecting disk.

As a preference, a pressing plate for fixing the flexible shaft is connected to a side of the rotating disk, and a guiding plate for guiding the flexible shaft is connected to a side of the connecting disk, one end of the flexible shaft is connected to the rotating disk and arranged around the center of the rotating disk, and the other end of the flexible shaft is located at the center of the guiding plate, so that the flexible shaft can be limited in the center of the rotating disk, and the movement of the flexible shaft is guided by the guiding plate, so that the rotation of the rotating disk drives the flexible shaft to perform telescopic movement and accurately enter the through hole and the insertion hole.

As a preference, at least one weight block is provided, and the lock and the second slot are respectively provided on both sides of the weight block, the lock is snap-fitted with the second slot. The latter weight block is clamped in the second slot of the previous weight block through the lock, so that the weight block can be sequentially added and installed through the lock and the second slot, thereby allowing the user to disassemble and adjust the weight blocks according to the characteristics of required fitness exercises.

As a preference, surfaces of the fixed block and the weight block are connected with guiding rails, and the other side of the weight block is provided with guiding grooves that cooperate with the guiding rails. The weight block can be installed and fixed on the side of the fixed block with the cooperation of the guiding rail and the guiding groove, and the two sides of the weight block are respectively provided with guiding rails and guiding grooves, so that the user can sequentially add additional weight blocks through the guiding rail and the guiding groove, which effectively improves the user's convenience in installing the weight blocks.

As a preference, the guiding rail and the guiding groove are connected by sliding fit, and at least one group of the guiding rail and the guiding groove is provided. Both sides of the weight block are respectively provided with guiding rails and guiding grooves. The side of the fixed block is provided with a guiding rail or a guiding groove corresponding to one side of the weight block. This facilitates the installation of the weight block on the fixed block through the cooperation of the guiding rail and the guiding groove, and improve, the installation between the fixed block and the weight block and between the weight block and the weight block through the cooperation of multiple groups of guiding rails and guiding grooves. The stability after connection can effectively avoid safety problems such as loosening and falling of the weight block.

The beneficial effect of the present application is: The convenient weight-adjustable dumbbell has the characteristics of simple operation and convenient use, and is convenient for the user to quickly replace or add weight blocks, effectively reducing the time required for the user to adjust the weight of the dumbbell, and improving the fitness effect of the user; Since the inside of the rotating disk is surrounded by a flexible shaft for penetrating the connecting dick and the fixed block, and the center of the weight block is provided with an insertion hole for the flexible shaft to pass through, so that the user can control the length of the flexible shaft to be extended by rotating the handle connected to the rotating disk. By extending the flexible shaft into the fixed block and the weight blocks for connection, it is convenient for the user to extend the flexible shaft and connect it to multiple weight blocks according to the characteristics of fitness exercises. When the flexible shaft is inserted into the insertion hole, the abutment rod covered in front of the insertion hole can be pressed, so that when the flexible shaft is connected to the counterweight, the lock on the surface of the weight block can be snapped on the fixed block or another weight block in time, so that the user can quickly disassemble or add the weight of the dumbbell. This effectively reduces the time required for the user to adjust the weight of the dumbbell when exercising and improving the convenience and effect of the user exercising.

REFERENCE SIGNS

Figure 1:
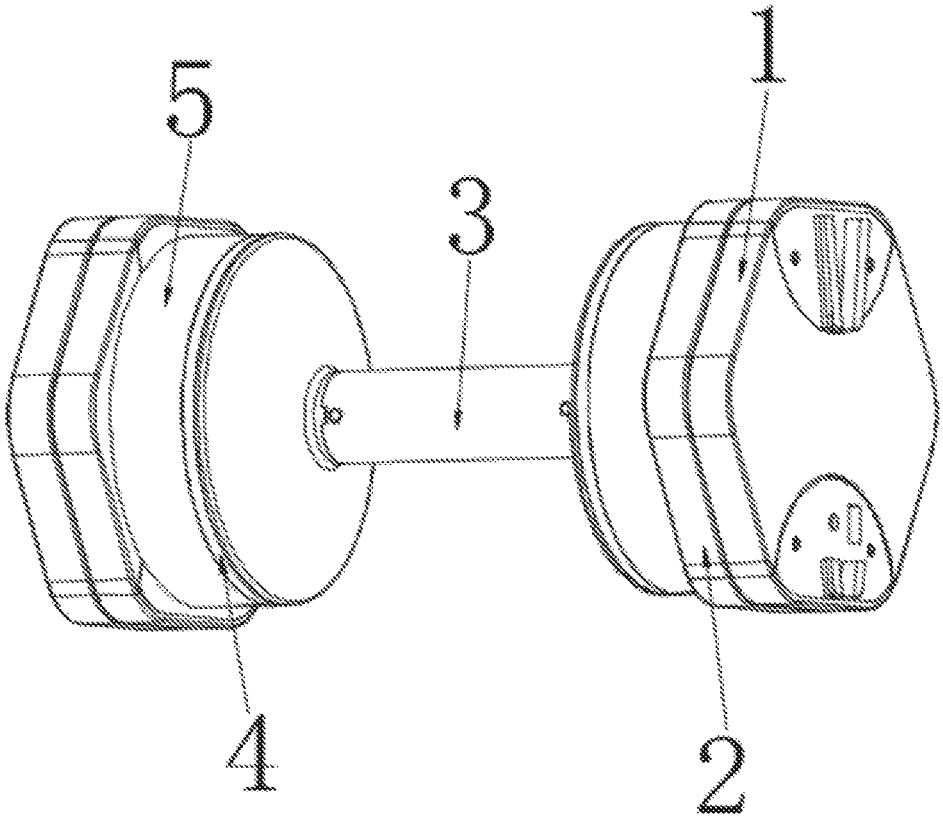
FIG. 1 is the overall structure schematic structural diagram of the weight-adjustable dumbbell according to the present application.

Weight block 1, Guiding slot 11. Insertion hole 12. Second slot 13, Fixed block 2, Guiding rail 21, Through hole 22, First slot 23, Handle 3. Rotating disk 4, Cylinder 41, Connecting disk 5, Column buckle 51, Lock 6, Pin shaft 61, Elastic member 62, Buckle 63, Abutment rod 64, Slide groove 65, Flexible shaft 7, Guiding plate 71, Pressing plate 72.

DETAILED DESCRIPTION

The specific implementation manner of the present application will be further described below in conjunction with the accompanying drawings. It should be noted here that the descriptions of these implementations are used to help the understanding of the present application, but are not intended to limit the present application. In addition, the technical features involved in the various embodiments of the present application described below may be combined with each other as long as there is no conflict with each other.

Figure 2:
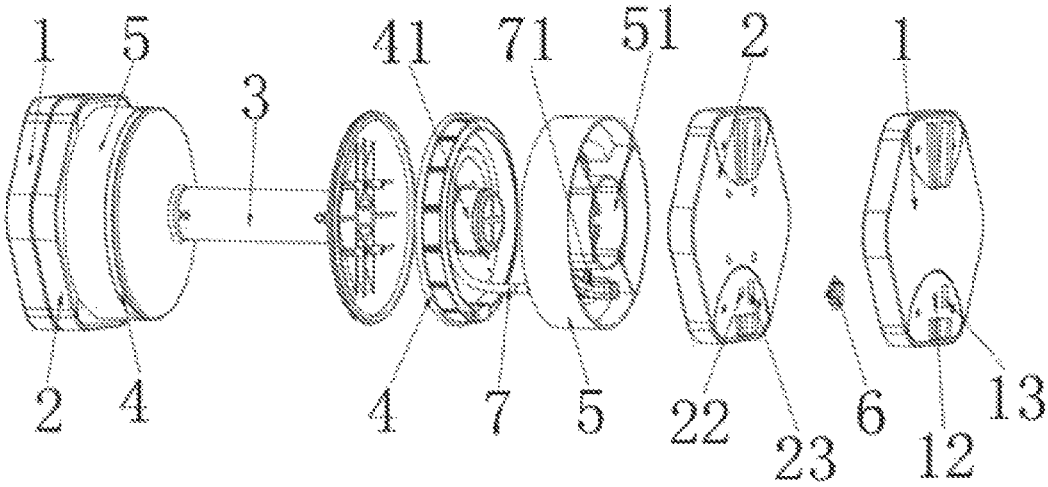
FIG. 2 is an exploded diagram of the weight-adjustable dumbbell according to the present application.
Figure 3:
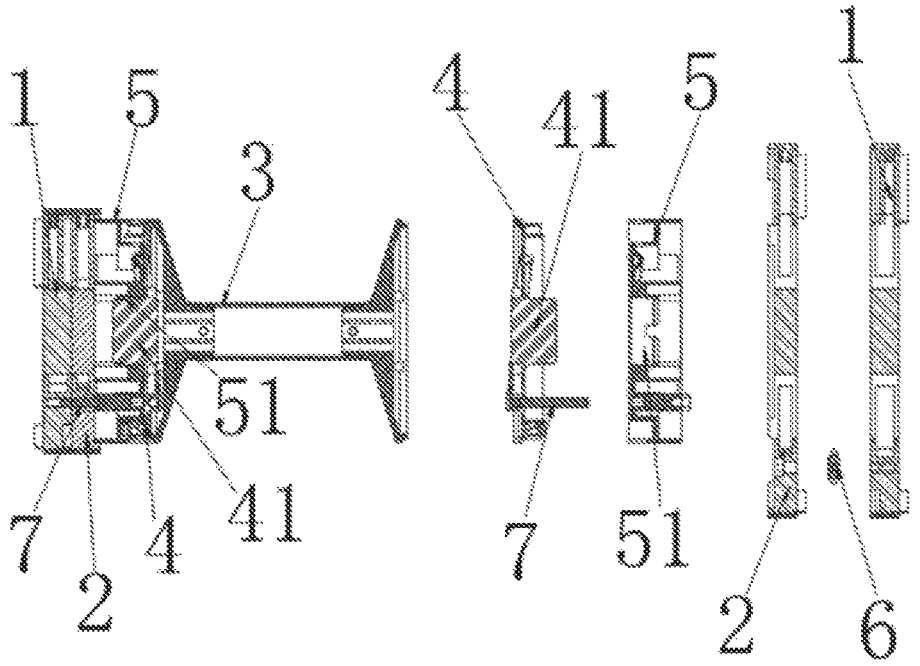
FIG. 3 is a cross-sectional diagram of a weight-adjustable dumbbell according to the present application.
Figure 4:
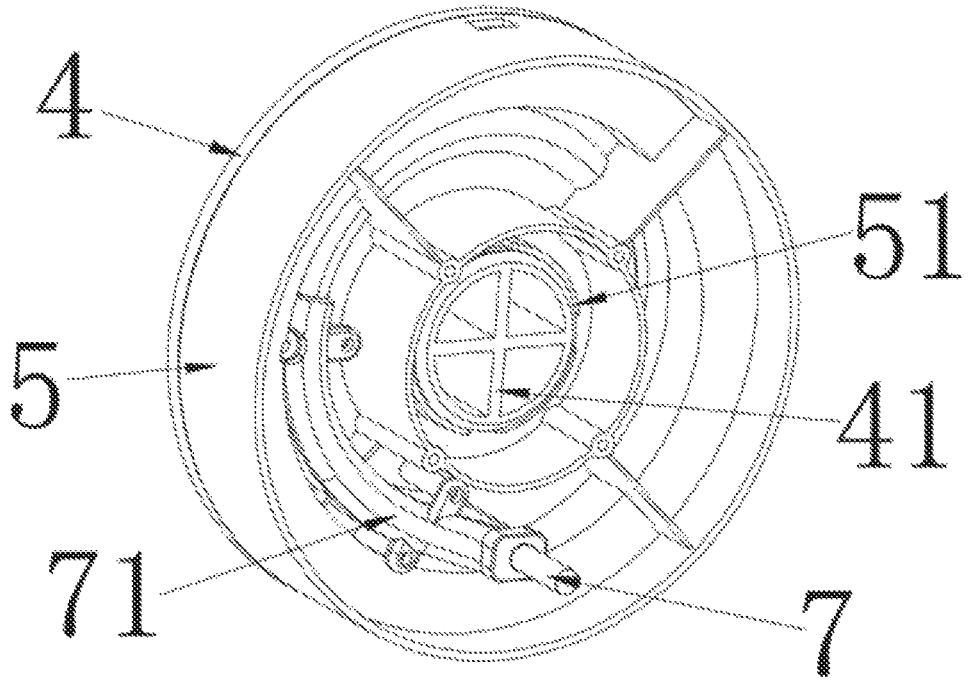
FIG. 4 is a connection structure diagram of the rotating disk and the connecting disk in the weight-adjustable dumbbell according to the present application.
Figure 5:
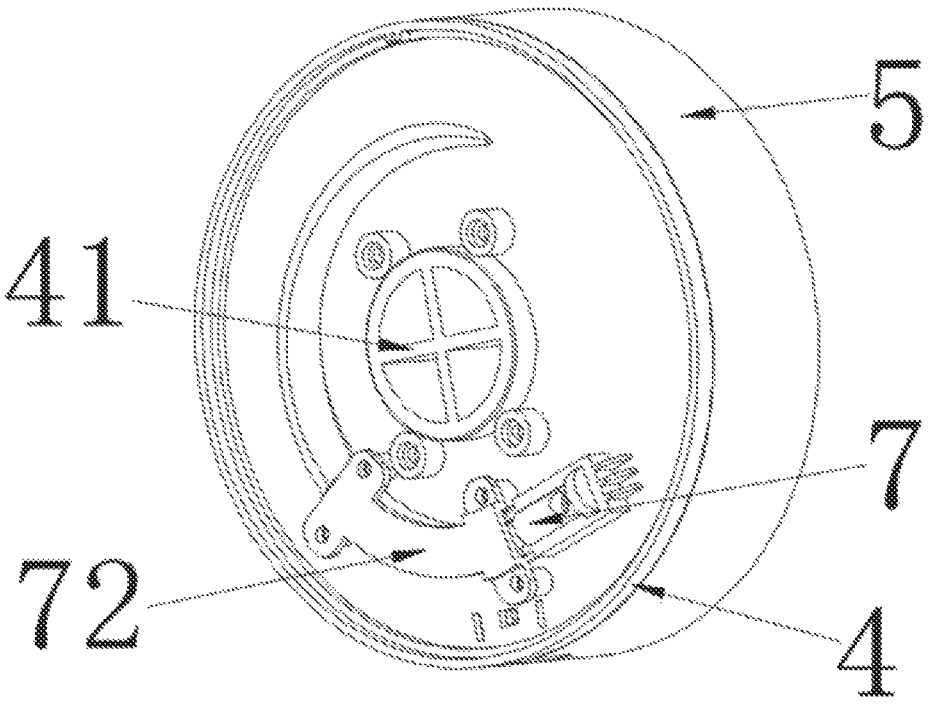
FIG. 5 is a schematic structural diagram of another direction of FIG. 4.
Figure 6:
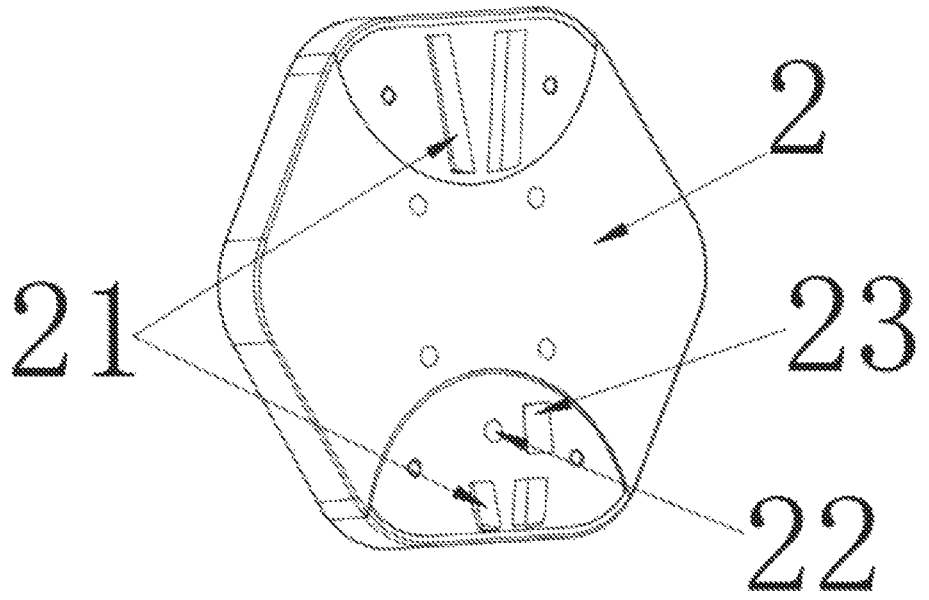
FIG. 6 is a schematic structural diagram of a fixed block in the weight-adjustable dumbbell according to the present application.
Figure 7:
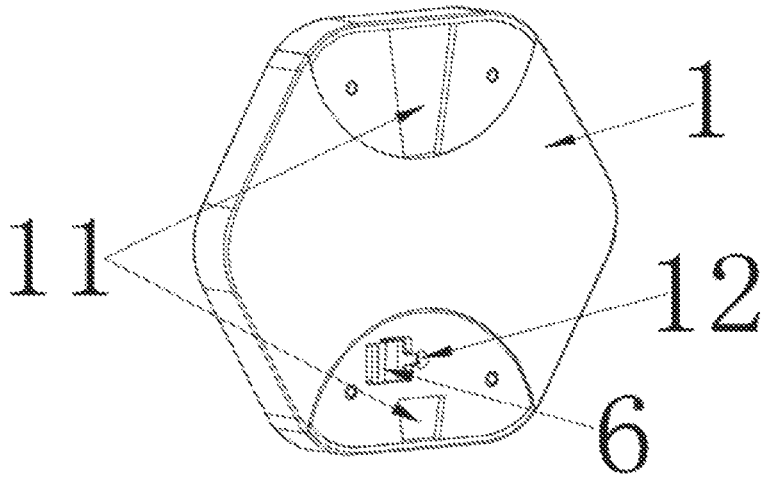
FIG. 7 is a schematic structural diagram of a weight block in the weight-adjustable dumbbell according to the present application.
Figure 8:
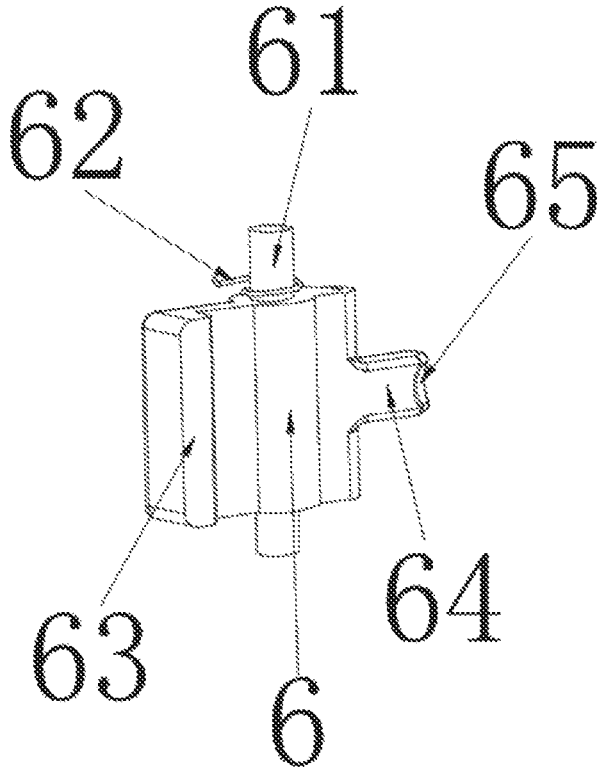
FIG. 8 is a schematic structural diagram of the lock in the weight-adjustable dumbbell according to the present application.

As shown in FIGS. 1-8, a convenient weight-adjustable dumbbell comprises a handle 3 and a rotating disk 4 connected to both ends of the handle 3, a connecting disk 5 is movably connected to a side of the rotating disk 4, and a fixed block 2 is connected to a side of the connecting disk 5, wherein a flexible shaft 7 is connected to the side of the rotating disk 4, and the flexible shaft 7 runs through the connecting disk 5 and the fixed block 2, an outer side of the fixed block 2 is detachably connected with weight blocks 1, one side of the weight block 1 is connected with a lock 6 for connecting the fixed block 2, the other side of the weight block 1 is provided with a second slot 13, and the center of the weight block 1 is provided with a insertion hole 12 for the passage of the flexible shaft 7.

A side of the fixed block 2 is provided with a first slot 23 that cooperates with the lock 6 and connects with each other. The second slot 13 provided on the other side of the weight block 1 is connected with the lock 6, and the lock 6 is movably connected with the weight block 1, so that the lock 6 can move on the surface of the weight block 1, so that the lock 6 in the weight block 1 can be snapped into the first slot 23. The weight block 1 and the fixed block 2 can be connected and fixed to each other, and the lock 6 of the subsequent weight block 1 is matched with the second slot 13 of the previous weight block 1, so as to realize the connection and installation of multiple weight blocks 1.

The center of the lock 6 is connected with a pin shaft 61 that is rotatably connected with the weight block 1, and an elastic member 62 is arranged between the lock 6 and the weight block 1, and one side of the lock 6 is connected with a buckle 63 for being locking into the first slot 23 and the second slot 13. The elastic member 62 can be a spring, so that the lock 6 and the weight block 1 are movably connected through the pin shaft 61, and can be fixed through the snap-fit connection between the buckle 63 connected to the surface of the lock 6 and the first 23 or second slot 13. The arrangement of the elastic member 62 allows the lock 6 to return to its original position without external force. The snap fit connection between the buckle 63 and the first slot 23 facilitates the installation of the weight block 1 on the fixed block 2. The buckle 63 of the extra weight block 1 is snap-fitted with the second slot 13 of the previous weight block 1 so as to facilitate the installation of the extra weight block 1 on the previous weight block 1, thereby realizing sequentially stacked connections.

The other side of the lock 6 is connected to an abutment rod 64, and an end of the abutment rod 64 is provided with a slide groove 65, and the slide groove 65 is located on front of the insertion hole 12, so that the abutment rod 64 can half cover the front of the insertion hole 12, and when the flexible shaft 7 is embedded in the insertion hole 12, the abutment rod 64 can be pressed, so that the pressing action of the abutment rod 64 drives the lock 6 to rotate, so that the buckle 63 on the other side of the lock 6 can be snapped into the first slot 23 or the second slot 13. The arrangement of the slide groove 65 at the end of the abutment rod 64 facilitates the entry of the flexible shaft 7 into the insertion hole 12, which not only facilitates the introduction of the flexible shaft 7 into the insertion hole 12 through the slide groove 65, but also avoids the possibility that the abutment rod 65 is completely covered above the insertion hole 12 so that the flexible shaft 7 cannot enter the insertion hole 12.

A through hole 22 for passing the flexible shaft 7 is arranged in the center of the fixed block 2, and the axial center of the through hole 22 and the axial center of the insertion hole 12 are on the same straight line, so that the flexible shall 7 can pass through the fixed block 2 and the weight block 1 through the through hole 22 and the insertion hole 12, so that the flexible shaft 7 connects the fixed block 2 and the weight block 1 to limit the position.

A cylinder 41 is connected to the center of the rotating disk 4, and a column buckle 51 rotatably connected to the cylinder 41 is provided at the center of the connecting disk 5. The cylinder 41 and the column buckle 51 can be connected by snap fit or by bearing rotation, so that the cylinder 41 can be clipped and embedded in the column buckle 51, so that the rotating disk 4 and the connecting disk 5 can be connected through the cylinder 41 and the column buckle 51, and allow the rotating disk 5 to rotate on one side of the connecting disk 5.

A pressing plate 72 for fixing the flexible shaft 7 is connected to a side of the rotating disk 4, and a guiding plate 71 for guiding the flexible shaft 7 is connected to a side of the connecting disk 5, one end of the flexible shaft 7 is connected to the rotating disk 4 and arranged around the center of the rotating disk 4, and the other end of the flexible shaft 7 is located at the center of the guiding plate 71, so that the flexible shaft 7 can be limited in the center of the rotating disk 4, and the movement of the flexible shaft 7 is guided by the guiding plate 71, so that the rotation of the rotating disk 4 drives the flexible shaft 7 to perform telescopic movement and accurately enter the through hole 22 and the insertion hole 12.

At least one weight block 1 is provided, and the lock 6 and the second slot 13 are respectively provided on both sides of the weight block 1, the lock 6 is snap-fitted with the second slot 13. The latter weight block 1 is clamped in the second slot 13 of the previous weight block 1 through the lock 6, so that the weight block 1 can be sequentially added and installed through the lock 6 and the second slot 13, thereby allowing the user to disassemble and adjust the weight blocks 1 according to the characteristics of required fitness exercises.

Surfaces of the fixed block 2 and the weight block 1 are connected with guiding rails 21, and the other side of the weight block 1 is provided with guiding grooves 11 that cooperate with the guiding rails 21. The weight block 1 can be installed and fixed on the side of the fixed block 2 with the cooperation of the guiding rail 21 and the guiding groove 11, and the two sides of the weight block 1 are respectively provided with guiding rails 21 and guiding grooves 11, so that the user can sequentially add additional weight blocks 1 through the guiding rail 21 and the guiding groove 11, which effectively improves the user's convenience in installing the weight blocks 1.

The guiding rail 21 and the guiding groove 11 are connected by sliding fit, and at least one group of the guiding rail 21 and the guiding groove 11 is provided. Both sides of the weight block 1 are respectively provided with guiding rails 21 and guiding grooves 11. The side of the fixed block 2 is provided with a guiding rail 21 or a guiding groove 11 corresponding to one side of the weight block 1. This facilitates the installation of the weight block 1 on the fixed block 2 through the cooperation of the guiding rail 21 and the guiding groove 11, and improves the installation between the fixed block 2 and the weight block 1 and between the weight block 1 and the weight block 1 through the cooperation of multiple groups of guiding rails 21 and guiding grooves 11. The stability after connection can effectively avoid safety problems such as loosening and falling of the weight block 1.

Both ends of the handle of the weight-adjustable dumbbell are sequentially connected with a rotating disk 4, a connecting disk 5, a fixed block 2 and a weight block 1. There can be several weight blocks 1, and according to the weight of the user's desired exercise, the fixed block 2 and the weight block 1, and the weight blocks 1 are spliced and installed by the cooperation of the guiding rail 21 and the guiding groove 11. Then the user turns the handle 3 and simultaneously drives the rotating disk 4 connected to the handle 3, so that the flexible shaft 7 in the rotating disk 4 can extend into the insertion hole 12 of the weight block 1 through the through hole 22. When the flexible shaft 7 is inserted into the insertion hole 12, the abutment rod 64 on the lock 6 is pressed, so that the lock 6 of the weight block 1 can engage with the first slot 23 of the fixed block 2. The lock 6 of the latter weight block 1 is clamped on the previous weight block 1 through the second slot 13, so that the fixed block 2 and the weight block 1 are mutually clamped and installed, and the weight blocks 1 are connected to each other sequentially. The flexible shaft 7 is restricted to be wound in the center of the rotating disk 4, and it can be a steel cable, a chain or other soft strips that can penetrate the fixed block 2 and the weight block 1 while pressing the abutment rod 64 in the lock 6; The fixed block 2 is a reference mounting plate for installing the weight block 1, and the fixed block 2 can be consistent with the weight block 1, so that the weight block 1 is connected and installed on the side of the connecting disk 5 through the fixed block 2.

The beneficial effect of the present application is: The convenient weight-adjustable dumbbell has the characteristics of simple operation and convenient use, and is convenient for the user to quickly replace or add weight blocks, effectively reducing the time required for the user to adjust the weight of the dumbbell, and improving the fitness effect of the user; Since the inside of the rotating disk is surrounded by a flexible shaft for penetrating the connecting dick and the fixed block, and the center of the weight block is provided with an insertion hole for the flexible shaft to pass through, so that the user can control the length of the flexible shaft to be extended by rotating the handle connected to the rotating disk. By extending the flexible shaft into the fixed block and the weight blocks for connection, it is convenient for the user to extend the flexible shaft and connect it to multiple weight blocks according to the characteristics of fitness exercises. When the flexible shaft is inserted into the insertion hole, the abutment rod covered in front of the insertion hole can be pressed, so that when the flexible shaft is connected to the counterweight, the lock on the surface of the weight block can be snapped on the fixed block or another weight block in time, so that the user can quickly disassemble or add the weight of the dumbbell. This effectively reduces the time required for the user to adjust the weight of the dumbbell when exercising and improving the convenience and effect of the user exercising.

The embodiment of the present application has been described in detail above in conjunction with the accompanying drawings, but the present application is not limited to the embodiment described. For those skilled in the art, without departing from the principle and spirit of the present application, various changes, modifications, replacements and amendments to these embodiments still fall within the protection scope of the present application.

What is claimed is:

1. A weight-adjustable dumbbell, comprising a handle and two rotating disks, wherein each rotating disk of the two rotating disks is connected to a respective end of the handle, two connecting disks, wherein each connecting disk of the two rotating disks is movably connected to a side of a respective rotating disk of the two rotating disks, and two fixed blocks, wherein each fixed block of the two fixed blocks is connected to a side of a respective connecting disk of the two connecting disks, wherein each rotating disk is provided with a flexible shaft, and the flexible shaft is connected to the side of the respective rotating disk and runs through the respective connecting disk and the respective fixed block, an outer side of each of the fixed blocks is detachably connected with at least one weight block, wherein the corresponding weight block comprises a lock, and the lock is arranged at one side of each weight block for connecting the at least one weight block to the corresponding fixed block, another side of each weight block is provided with a second slot, and each weight block is provided with an insertion hole for the corresponding flexible shaft to pass through.

2. The weight-adjustable dumbbell according to claim 1, wherein the side of each fixed block of the two fixed blocks is provided with a first slot that cooperates with the corresponding lock, and the lock is movably connected with the corresponding weight block.

3. The weight-adjustable dumbbell according to claim 2, wherein a center of each lock is connected with a pin shaft that is rotatably connected with the corresponding weight block, and an elastic member is arranged between the lock and the at least one weight block, and one side of the corresponding lock is connected with a buckle for locking into the corresponding first slot and the second slot.

4. The weight-adjustable dumbbell according to claim 3, wherein another side of each lock is connected to an abutment rod, and an end of the abutment rod is provided with a slide groove, and the slide groove is located in front of the insertion hole.

5. The weight-adjustable dumbbell according to claim 4, wherein a through hole for passing the flexible shaft is arranged in the center of each fixed block, and the through hole and the corresponding insertion hole are coaxial.

6. The weight-adjustable dumbbell according to claim 1, wherein a cylinder is connected to the center of each rotating disk of the two rotating disks, and a column buckle rotatably connected to the cylinder is provided at the center of the corresponding connecting disk.

7. The weight-adjustable dumbbell according to claim 1, wherein a pressing plate for fixing the flexible shaft to the respective connecting disk is connected to a side of each rotating disk, and a guiding plate for guiding the flexible shaft is connected to a side of each connecting disk, one end of the flexible shaft is connected to the respective rotating disk and arranged around the center of the respective rotating disk, and the other end of the flexible shaft is located at the center of the guiding plate.

8. The weight-adjustable dumbbell according to any one of claim 1, wherein: the lock and the second slot are respectively provided on both sides of each of the at least one weight blocks, and the lock is snap-fitted with the second slot.

* * * * *